United States Patent [19]

Kramer

[11] Patent Number: 4,679,719

[45] Date of Patent: Jul. 14, 1987

[54] ELECTRONIC CONTROL FOR A PNEUMATIC FASTENER DRIVING TOOL

[75] Inventor: Francis J. Kramer, Edgewood, Ky.

[73] Assignee: Senco Products, Inc., Cincinnati, Ohio

[21] Appl. No.: 814,189

[22] Filed: Dec. 27, 1985

[51] Int. Cl.[4] ..... B25C 1/06

[52] U.S. Cl. ..... 227/5; 227/131

[58] Field of Search ..... 227/1, 2, 7, 8, 130, 227/120, 131, 5

[56] References Cited

U.S. PATENT DOCUMENTS

| | | | |
|---|---|---|---|
| 3,278,104 | 10/1966 | Becht et al. | 227/130 |
| 3,278,106 | 10/1966 | Becht et al. | 227/130 X |
| 3,964,659 | 6/1976 | Eiben et al. | 227/7 X |
| 4,298,072 | 11/1981 | Baker et al. | 227/7 X |
| 4,500,938 | 2/1985 | Dulin | 227/131 X |
| 4,516,713 | 5/1985 | Meijer | 227/1 X |
| 4,556,803 | 12/1985 | Weigert | 227/131 X |

*Primary Examiner*—Paul A. Bell

*Attorney, Agent, or Firm*—Frost & Jacobs

[57] ABSTRACT

An electronic control system for a pneumatic fastener driving tool of the type having a body containing a cylinder with a piston mounting a driver, a firing valve above and normally closing the upper end of the cylinder, and a space or volume above the firing valve. The volume above the firing valve is normally connected to a source of air under pressure to maintain the firing valve closed. When this volume is connected to exhaust the firing valve opens allowing air under pressure within the cylinder above the piston to cycle the tool. The electronic control system comprises a solenoid actuated valve which, when actuated, connects the volume above the firing valve to exhaust to cycle the tool, a source of electrical current and a control circuit. The control circuit establishes a desired mode of operation for the tool and has inputs from at least a manual trigger and a safety and interprets the inputs including their presence or absence and their sequence. When the inputs satisfy the desired mode of operation, the control circuit will generate an output signal to the valve solenoid and the tool will cycle.

36 Claims, 11 Drawing Figures

ELECTRONIC CONTROL FOR A PNEUMATIC FASTENER DRIVING TOOL

TECHNICAL FIELD

The invention relates to an electronic control system for a pneumatic fastener driving tool, and more particularly to such a system having a solenoid actuated valve constituting a pneumatic-electronic interface and a control circuit which determines the mode of operation of the tool and which interprets a series of input signals and actuates the solenoid operated valve to cycle the tool when the input signals satisfy the desired mode of operation.

BACKGROUND ART

Prior art workers have devised many types of pneumatic fastener driving tools. In its most usual form, the pneumatic fastener driving tool has a manual trigger and a safety, both of which must be actuated in order for the tool to fire. The most usual type of safety comprises a workpiece responsive trip which contacts the workpiece and is shifted thereby. Most frequently the workpiece responsive trip disables the manual trigger, unless the trip is pressed against the workpiece. An example of such a tool is taught in U.S. Pat. No. 3,278,106.

Prior art workers have also devised a number of additional safety means for such tools. As an example, U.S. Pat. No. 3,964,659 teaches a pneumatic fastener driving tool provided with safety means introducing into the firing sequence of the firing control means a time limit within which both the manual trigger and the trip must achieve their firing positions. If the manual trigger and the trip do not achieve their firing positions within the time limit, the firing sequence must be reinitiated with a selected one or both of the manual trigger and the trip initially in their normal positions.

In addition, pneumatic fastener driving tools have been developed which are provided with a "Auto-Fire" mode of operation wherein the operator can drive a plurality of fasteners by simply pulling the trigger and moving the fastener driving tool along the workpiece. U.S. Pat. No. 3,278,104 teaches such a fastener driving tool.

The pneumatic fastener driving art has achieved a high degree of sophistication. However, the more sophisticated pneumatic fastener driving tools have become, the more complex they have become and more expensive to manufacture. Various types of mechanical safeties have critical timing. If their parts become worn, their safety features are lost. Some mechanical safety features can be bypassed by the operator. For example, operators have been know to wire a workpiece responsive trip in its depressed position. When this is done, the safety feature provided by the workpiece responsive trip is lost. Pneumatic safety devices are vulnerable to a faulty or nicked O-ring, or to a sticking valve.

The present invention is based upon the discovery that if a pneumatic fastener driving tool is provided with an electronic control system, it can be greatly simplified in construction, and complex valving and mechanical linkages can be eliminated. A pneumatic fastener driving tool having an electronic control system is more reliable, less expensive to manufacture and more versatile. Should the tool fail for lack of electrical power, it will fail in a safe mode. Pre-fire (firing of the tool upon connection to a source of air under pressure) is discouraged since the air gets to the volume above the firing valve more directly. The electronic control system lends itself well to an auto-fire mode of operation without complex valving. The auto-fire feature can be made adjustable, say over a range of from 1 to 20 cycles per second, for example. Furthermore, the control circuit may have a number of input signals in addition to those provided by the trigger and the safety. For example, an input signal may be provided from an empty magazine sensor to prevent dry firing. An input signal may be provided from an overpressure sensor, disabling the tool if the air under pressure is at too great a pressure. Furthermore, the control circuit itself can be designed with various built-in safety features. For example, the circuit can be designed to prevent cycling of the tool if the safety and trigger are not both activated within a predetermined time limit. An input signal may be provided to prevent cycling of the tool should the pressure of the air be too low.

The control circuit may be pre-programmed at the factory to establish a desired mode of operation of the tool. The tool could be provided with a control circuit enabling the operator to select one of a number of modes of operation. As yet another alternative, the operator could change the tool from one mode of operation to another by simply replacing one control circuit (in the form of a chip or the like) with another. Finally, the electronic control system of the present invention provides extra design flexibility for component placement within the tool.

DISCLOSURE OF THE INVENTION

According to the invention there is provided an electronic control system for a pneumatic fastener driving tool. The tool is of the type having a body containing a cylinder with a piston mounting a driver. A firing valve is located at the upper end of the cylinder and normally closes the cylinder upper end. There is a space or volume in the body above the firing valve which is normally connected to a source of air under pressure to maintain the firing valve in its closed position against the upper end of the cylinder. When this volume is connected to an exhaust port, the firing valve opens, allowing air under pressure within the cylinder above the piston to cycle the tbol.

In a preferred embodiment of the electronic control system, a normally open, three-way, solenoid-actuated valve is provided. In its normal open position, the valve connects the volume above the firing valve to a supply of air under pressure. In its closed position, the solenoid valve connects the volume above the firing valve to an exhaust passage to atmosphere, causing the tool to cycle. The electronic control system also comprises a source of electrical current and a control circuit. The control circuit has at least an input signal from the manual trigger of the tool and an input signal from the tool's safety. Additional safety input signals (as indicated above) and an auto-fire input signal may be provided, if desired.

In a second embodiment, a three-way, normally open valve is provided, similar to the valve described with respect to the preferred embodiment above. This three-way valve normally connects the volume above the firing valve to a supply of air under pressure. When shifted from its normally open to its closed position, the three-way valve connects the volume above the firing valve to an exhaust passage to atmosphere. Unlike the first mentioned embodiment, the three-way valve in this embodiment is manually shifted by the tool trigger or safety. A normally closed, two-way, solenoid-actuated valve is provided in the exhaust passage. In its normally closed position, the two-way valve closes the exhaust passage. The solenoid of the two-way valve is connected to a source of electricity and a control circuit similar to that described with respect to the first embodiment. An output signal from the control circuit will shift the two-way, solenoid valve from its normally closed position to its open position, opening the exhaust passage.

In both embodiments, the control circuit determines the mode of operation of the tool. The present invention contemplates three basic modes: a safety fire-trigger fire mode, a restrictive mode, and a sequential mode. Both the safety fire-trigger fire mode and the restrictive mode may be combined with an auto-fire mode, if desired. These three modes are exemplary only. Other modes can be devised within the spirit and scope of the invention.

In both embodiments, the control circuit interprets the inputs, including their presence or absence and their sequence. When the inputs satisfy the desired mode of operation, the control circuit will generate an output signal to the solenoid controlled valve, causing the tool to cycle.

DETAILED DESCRIPTION OF THE INVENTION

Figure 1:
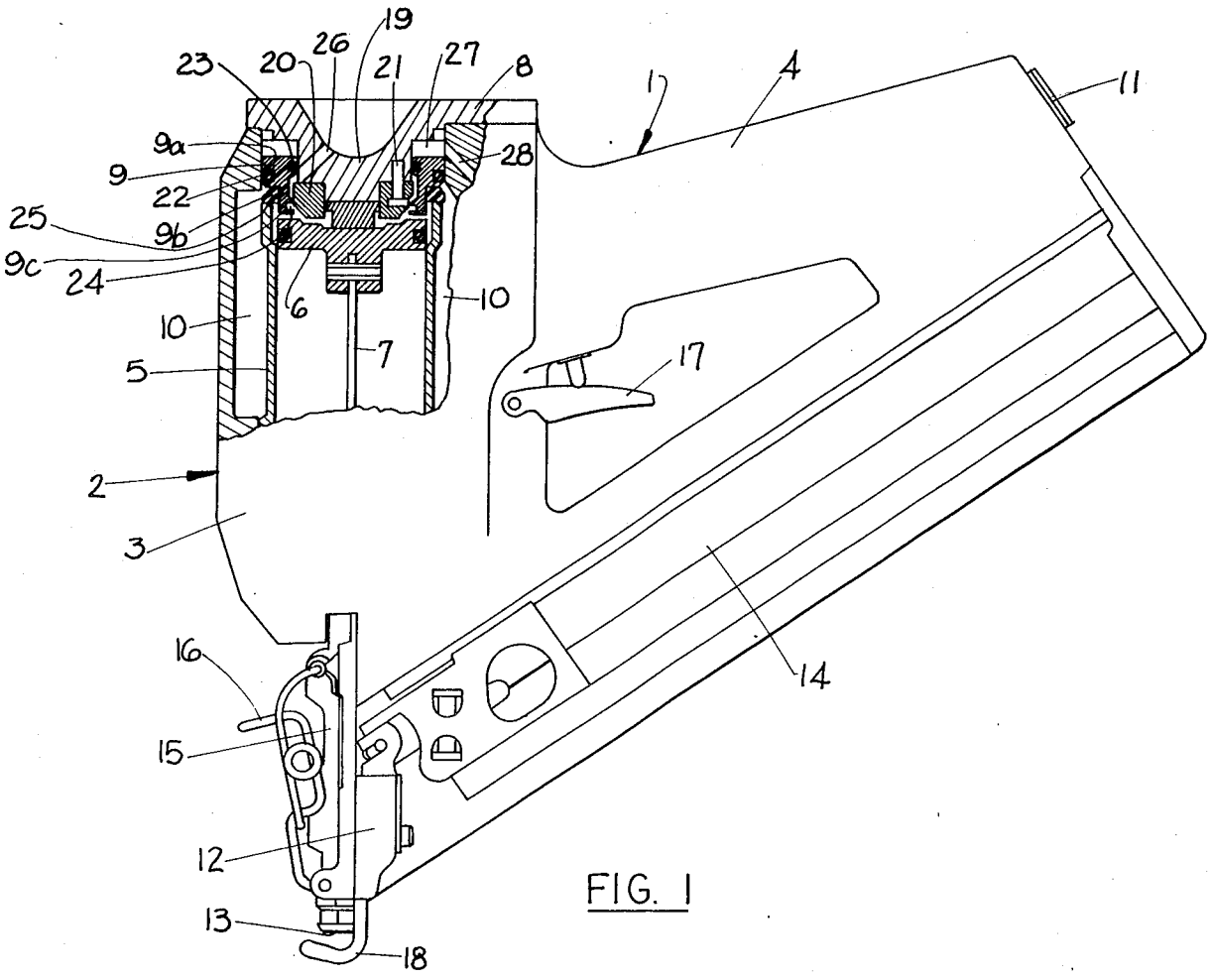
FIG. 1 is a side elevational view, partly in cross section, of an exemplary pneumatic fastener driving tool to which the teaching of the present invention can be applied.

Reference is first made to FIG. 1 wherein an exemplary pneumatic fastener driving tool of the type to which the present invention can be applied is shown. The tool is generally indicated at 1 and comprises a housing generally indicated at 2. The housing 2 has a body portion 3 and a handle portion 4. The body portion 3 and handle portion 4 are generally hollow. A working cylinder 5 is located within body portion 3 and is provided with a piston 6 to which a driver 7 is affixed.

The upper end of body portion 3 is closed by a cap 8 which supports a firing valve assembly 9. The tool 1 is provided with a reservoir 10 for air under pressure which surrounds the cylinder 5 and extends into handle portion 4. The air reservoir 10 is connected to an appropriate source of air under pressure through a line (not shown) having a fitting (not shown) engageable in the port 11 at the rearward end of the housing handle portion 4.

Beneath the housing body portion 3, the tool 1 is provided with a guide body 12 terminating in a nose piece 13. The guide body provides an internal passage or drive track for driver 7 and into which fasteners (not shown) are successively delivered from the fastener magazine 14. The guide body 12 may be provided with a front gate 15 and a latch 16 therefor, by which access may be gained to the drive track. It will be understood that a fastener in the drive track will be driven downwardly through the nose piece and into a workpiece by the piston 6 and its driver 7, when the firing valve assembly 9 is opened, as will be described hereinafter.

A tool of the type being described is normally provided with a manual trigger 17 and a safety. The most common type of safety comprises a workpiece-contacting trip 18 which, when the tool nose piece is placed against a workpiece, contacts the workpiece and is urged upwardly thereby, as viewed in FIG. 1.

The firing valve assembly 9, in most prior art tools, is controlled by a complex remote valve assembly (not shown) which, in turn, is controlled by the manual trigger 17. The workpiece responsive trip 18 normally disables manual trigger 17 unless it is in its actuated position with the nose piece 13 of the tool pressed against a workpiece.

In the exemplary embodiment shown, the cap 8 has a downwardly depending central portion 19. An annular ring-like member 20 is affixed thereto in any suitable manner, as by machine screws, one of which is shown at 21. The firing valve assembly 9, illustrated in its closed position in FIG. 1, comprises an annular member adapted to shift vertically between the adjacent inner surface of housing body portion 3 and the downwardly depending portion 19 of cap 8 and the attached annular ring-like member 20. The firing valve assembly 9 has an upper enlarged portion **9*a*, a downwardly depending skirt portion 9*b* and a lower enlarged portion 9*c*. The upper enlarged portion 9*a* carries an O-ring 22 making a seal with the inside surface of the housing body portion 3. The upper enlarged portion 9*a* also carries an O-ring 23 making a seal with a peripheral surface of the downwardly depending portion 19 of cap 8. The lower enlarged portion 9*c* of firing valve assembly 9 carries an O-ring 24 capable of sealingly engaging a peripheral surface of the annular ring-like member 20. Finally, the exterior surface of the skirt portion 9*b* of the firing valve assembly 9 carries a sealing ring 25. The sealing ring 25 is slidable on the skirt portion 9*b* between the upper enlarged portion 9*a* and the lower enlarged portion 9*c* of the firing valve assembly 9**.

When the firing valve assembly is in its closed position, as illustrated, the O-ring 22 is in sealing contact with the inside surface of housing body portion 3, O-ring 23 is in sealing contact with its respective peripheral surface of portion 19 of cap 8, and O-ring 24 is out of sealing contact with the cylindrical upper portion of the annular ring-like member 20. Sealing ring 25 is shifted to its uppermost position on the skirt portion **9*b* of firing valve assembly 9. At the same time, the sealing ring 25 is in contact with the upper end of working cylinder 5, so as to close the cylinder with respect to air under pressure within reservoir 10**.

It will be noted that the downwardly depending portion 19 of cap 8 has one or more passages 26 therethrough leading to atmosphere. Thus, when the firing valve assembly is in its closed position and its O-ring 24 is out of sealing contact with the annular ring-like member 20, that portion of the working cylinder 5 above piston 6 is vented to atmosphere through the passages 26.

The firing valve assembly is normally maintained in its closed position (as shown) by air under pressure in the space or volume 27. The space or volume 27 is connected to reservoir 10 by passage 28. In prior art structures, the passage 28 is connected to the reservoir 10 through the complex remote valve (not shown). In the present invention, the passage 28 is connectable to the reservoir 10 through a simple three-way valve, as will be described hereinafter. It will be obvious from FIG. 1 that when the firing valve assembly 9 is in its closed position, it is operated upon by air under pressure both from above (volume 27) and below (reservoir 10). However, that area of firing valve assembly 9 operated upon by air under pressure in volume 27 is greater than that area of the firing valve assembly exposed to air under pressure directly from reservoir 10, so that the firing valve assembly 9 is biased to its closed position so long as passage 28 is open to air under pressure from reservoir 10.

In the prior art structure, when the remote valve (not shown) is actuated by manual trigger 17 and work responsive trip 18, the passage 28 is connected to exhaust or atmosphere. Thus the volume 27 is also connected to exhaust or atmosphere. Under these circumstances, air under pressure operating on the firing valve 9 directly from reservoir 10 can now cause the firing valve assembly to shift upwardly to its open position. This same air will initially tend to maintain sealing ring 25 seated against the upper end of working cylinder 5 while firing valve assembly 9 shifts upwardly, as a result, O-ring 24 of the firing valve assembly will come into sealing contact with the cylindrical upper portion of the annular ring-like member 20 thereby sealing off vent passages 26 prior to the opening of working cylinder 5. Additional upward movement of the firing valve assembly 9 will result in a lifting of sealing ring 25 from the upper end of working cylinder 5 by the enlarged portion 9*c* of the firing valve assembly. At this point, the piston 6 is exposed to air under pressure from reservoir 10 and is driven rapidly and with considerable force downwardly to drive the fastener within the drive track of guide body 12 into a workpiece. Upon release of manual trigger 17 or workpiece responsive trip 18, the remote valve (not shown) will reconnect passage 28, and thus volume 27, to reservoir 10. The greater effective surface area of the upper portion of firing valve assembly 9 will result in downward movement of the firing valve assembly. Sealing ring 25 being in its lowermost position with respect to firing valve assembly 9 will first contact the upper edge of working cylinder 5, closing the cylinder. Further downward movement of the firing valve assembly 7 will cause O-ring 24 thereof to release its sealing engagement from the upper cylindrical outer surface of annular ring-like member 20, thus venting that portion of the working cylinder 5, above the piston 6, to atmosphere through vent passage 26 in cap 8. Prior art workers have devised a number of ways to return piston 6 to its uppermost position, and the manner in which this is accomplished does not constitute a limitation on the present invention. For example, a return air reservoir (not shown) may be provided which is charged with air under pressure from reservoir 10 when the piston achieves its fully driven position. Air from the return air reservoir raises the piston 6 when the firing valve assembly 9 is in its closed position and the area above piston 6 is vented to atmosphere through passages 26.

The above description briefly outlines the operation of an exemplary prior art pneumatic fastener driving tool. It will be understood that the tool of FIG. 1 is exemplary only, and the teachings of the present invention are not limited to their application to this specific tool. For purposes of an exemplary showing, the electronic control system of the present invention will now be described in its application to such a tool.

Figure 2:
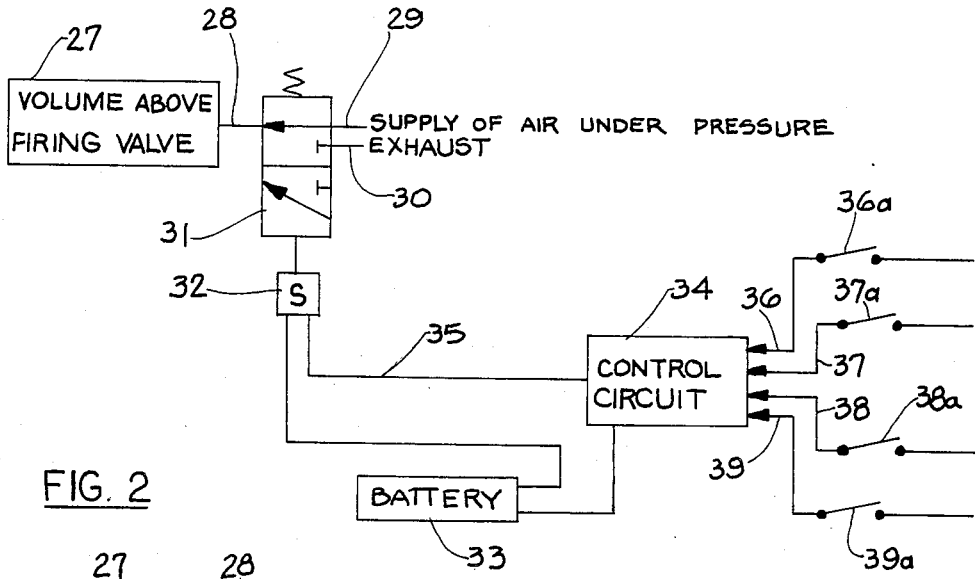
FIG. 2 is a diagrammatic representation of a first embodiment of the present invention.

Reference is made to FIG. 2. In FIG. 2, the space or volume 27 of FIG. 1 is diagrammatically shown at 27, as is passage 28. The diagram of FIG. 2 also shows a passage 29 leading to a supply of air under pressure (such as reservoir 10 of FIG. 1), and an exhaust passage 30 leading to atmosphere.

The control system of the present invention comprises a normally open, three-way valve 31 actuated by a solenoid 32. The solenoid actuated valve 31 serves as the pneumatic-electronic interface. FIG. 2 shows valve 31 in its normal open position wherein the exhaust passage 30 is blocked and the volume 27 above the firing valve is connected to a supply of air under pressure (reservoir 10, for example). It will be apparent from FIG. 2 that if valve 31 is shifted by solenoid 32 to its closed position, passage 29 from the supply of air under pressure will be blocked and the volume 27 above the firing valve will be connected to exhaust or atmosphere. The solenoid 32 is connected to a source of electrical current 33 and a control circuit 34. The source of electrical current 33 and the control circuit 34 may be remote from the tool 1. Such an arrangement might be advantageous in an assembly line set-up, or in instances where the tool is used in an environment harmful to the control circuit, or where a master control is used to operate a plurality of tools. Alternatively the source of electrical current can be self-contained, such as a battery, and mounted in the tool itself. The same is true with respect to the control circuit 34. Excellent results have been achieved when the source of electricity comprised a conventional 9 volt battery. Such a battery enabled the tool to be cycle over 350,000 times before replacement of the battery was required.

The control circuit 34 not only actuates solenoid 32, but also governs the mode of operation of the tool. In the preferred embodiment, control circuit 34 will be set up for one of three exemplary primary modes of operation. For convenience, these three exemplary primary modes have been termed the safety fire-trigger fire mode, the restrictive mode and the sequential mode. These modes will be explained fully hereinafter. In the preferred embodiment, the control circuit 34 will be set up or designed for a desired one of these modes and installed at the factory. Nevertheless, it is within the scope of the invention to provide the tool to the customer with three interchangeable control circuits so that the operator can choose different modes of operation at different times. It is further within the scope of the invention to provide the tool with a single control circuit capable of operating the tool in all three modes, the tool being provided with an appropriate selector, enabling the operator to select the desired mode of operation. The control circuit can be implemented in any one of the well known ways. For example, circuit 34 could comprise a digital electronic circuit, or a microprocessor. Control circuit 34 could even be implemented as an electro-mechanical circuit. Implementation of the control circuit can readily be accomplished by the skilled worker in the art familiar with the teachings herein.

Control circuit 34 will be provided with a number of inputs. For purposes of an exemplary showing, FIG. 2 illustrates four inputs 36, 37, 38 and 39. The number of inputs does not constitute a limitation of the present invention. Input 36 constitutes an input signal derived from the manual trigger 17 which will close a switch 36*a* when shifted to its actuated position. Input 37 constitutes an input signal provided by the safety or workpiece-responsive trip 18 which will close a switch 37*a* when in its depressed position against a workpiece. Input 38 could be an input signal from an auto-fire selector switch 38*a*. Input 39 could be an input signal from a safety device switch 39*a*. As mentioned above, the tool of the present invention could be provided with one or more safety devices including an empty magazine indictor to prevent dry firing, a input signal indicating that the supply of air under pressure is at too great a pressure An input signal could be provided indicating that the air under pressure is under too little pressure. Additional input signals could come from devices such as an ambient gas sensor, a broken tool sensor, and the like. For the three basic modes of operation to be described hereinafter, control circuit 34 must at least have input 36 from the manual trigger 17 and input 37 from the workpiece responsive trip 18. As indicated above, the number of inputs, in addition to these, does not constitute a limitation of the present invention.

Figure 3:
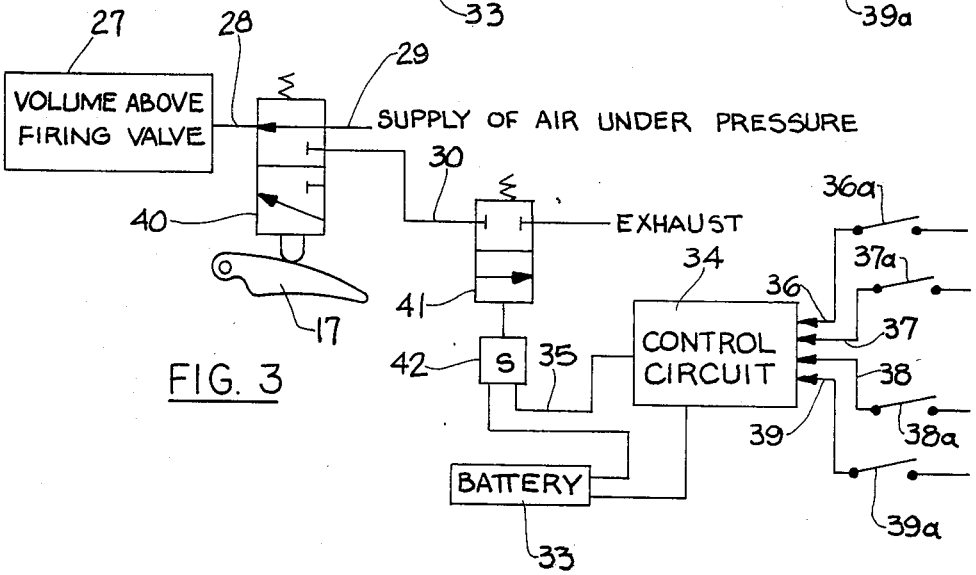
FIG. 3 is a diagrammatic representation of a second emodiment of the present invention.

FIG. 2 illustrates an alternate configuration for the control system of the present invention. Some of the parts are similar to those of FIG. 2 and have been given like index numerals. In FIG. 3, the volume 27 above the firing valve, the passage 28, the passage 29 to the supply of air under pressure and the passage 30 to exhaust are the same as in FIG. 2, as is also true of source of electrical circuit or battery 23 and control circuit 34 having inputs 36 through 39. Again, the number of inputs to the control circuit does not constitute a limitation of the present invention, except for the fact that input 36 from trigger 17 and input 37 from workpiece responsive trip 18 must be present.

In the embodiment of FIG. 3 a normally open three-way valve 40 is provided. The valve 40 differs from valve 31 only in that it is mechanically shifted from its normally open position as shown, to its closed position, by manual trigger 17, rather than by a solenoid controlled by control circuit 34. Valve 40 could be mechanically shifted by safety 18, rather than trigger 17, if desired. Again it will be evident that when the valve is in its normally open position, the volume 27 above the firing valve will be connected through passage 28 to passage 29 leading to a supply of air under pressure (such as reservoir 10). At the same time, the exhaust passage 30 will be blocked. When the valve 40 is shifted to its closed position, the passage 29 to the supply of air under pressure will be blocked and the passage 30 to exhaust or atmosphere will no longer be blocked by valve 40. In this embodiment, however, the exhaust passage 30 contains a second valve 41. Valve 41 constitutes a two-way normally closed, solenoid-actuated valve. Valve 41 is actuated by solenoid 42, which is connected to the source of electrical current 33 and the control circuit 34 in substantially the same manner as is solenoid 32 of FIG. 2.

It will be evident from FIG. 3 that when valve 41 is in its normally closed position, the passage 30 to exhaust or atmosphere is blocked. However, when valve 41 is shifted by solenoid 42 to its open position, the passage 30 to exhaust or atmosphere will no longer be blocked. As stated above, solenoid 32 of FIG. 2 is actuated by the output signal 35 of control circuit 34. Similarly, solenoid 42 of FIG. 3 will be actuated by output signal 35 of control circuit 34. In both embodiments, the control circuit 34 reads and interprets the input signals 36 through 39, determining their presence or absence and their sequence.

The three exemplary basic modes of operation for which the control circuits 34 of FIGS. 2 and 3 can be designed, will now be discussed. The first mode of operation, the safety fire-trigger fire mode, is one in which all that is required is that both the trigger 17 and the safety 18 are actuated. They may be actuated in any order. Once both are actuated, the tool will cycle. Either one of trigger 17 and safety 18 may be deactuated and reactuated to obtain another cycle.

Figure 4:
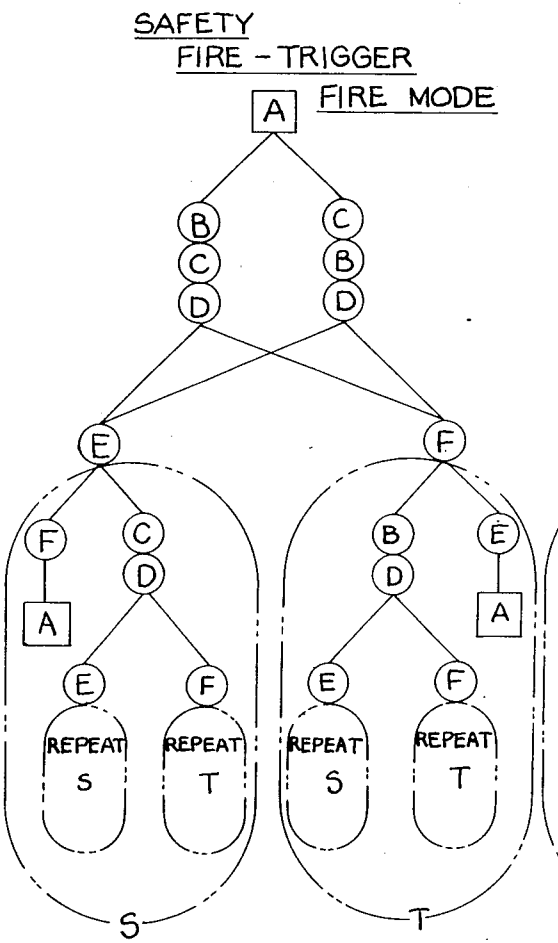
FIGS. 4, 5 and 6 are state diagrams for the safety fire-trigger fire mode, the restrictive mode and the sequential modes respectively.

FIG. 4 is a state diagram for the safety fire-trigger fire mode. The letters used in the diagram represent the following:

A=home position
B=activate safety 18
C=activate trigger 17
D=tool fires
E=release trigger 17
F=release safety 18

If from the at home or normal state of the tool the left hand column of FIG. 4 is followed, the safety 18 is first activated, followed by activation of trigger 17, and the tool will cycle. The first cycling is followed by a pair of alternatives. Either the trigger 17 may first be released or the safety 18 may first be released. Remaining with the left-hand side of the state diagram, and assuming that the trigger 17 is first released, another pair of alternatives is presented. If the release of trigger 17 is followed by the release of safety 18, the tool will return to its normal state or home position. If release of trigger 17 is followed by reactivation of trigger 17, the tool will cycle again. Once the tool has cycled for a second time, its state is similar to that following the first cycling. If the trigger 17 is first released, the states in the oval S can be repeated. If the safety 18 is first released, the states in the oval T, next to be described, can be followed.

Following the first cycling described above, if the safety is first released, the alternative sets of states presented in oval T can then be followed. Thus, if after the first cycling the safety 18 is first released, followed by a release of trigger 17, the tool will return to its normal state or home position. If, after the first cycling the safety 18 is first released and then is reactivated, the tool will cycle for a second time and again its state is the same as after the first cycling. If the trigger 17 is first released, the states of oval S can be repeated. If the safety 18 is first released, the states of oval T can be repeated.

Following the right hand column of FIG. 4, if from the normal state or home position of the tool the trigger 17 is first activated, followed by activation of safety 18, the tool will cycle. If after this first cycling of the tool the trigger 17 is first released, either of the series of states provided in oval S can be followed. If, after the first cycling the safety 18 is first released, then either of the alternative sets of states in oval T can be followed.

It will be evident from the state diagram of the safety fire-trigger fire mode, that if trigger 17 and safety 18 are both activated, in any order, the tool will cycle. If both the trigger 17 and the safety 18 are released, in any order, the tool will return to its normal state. If after cycling, one of the trigger 17 and safety 18 remains activated and the other of trigger 17 and safety 18 is released and then reactivated, the tool will cycle again.

Figure 7:
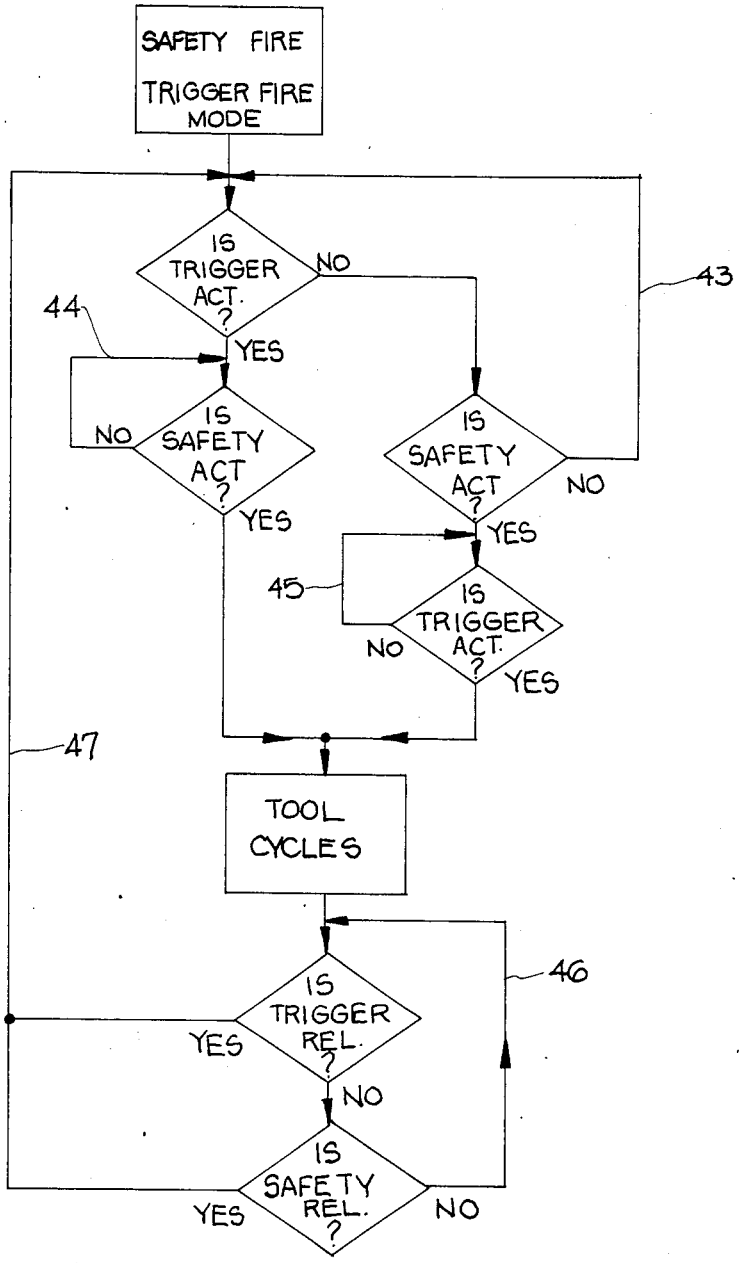
FIG. 7 is a flow diagram for the safety fire-trigger fire mode.

Reference is now made to FIG. 7 which comprises a flow diagram for the control circuit 34 of FIGS. 2 or 3, having been designed or programmed for the safety fire-trigger fire mode of operation. When the control circuit 34 is activated by the source of electrical current 33 and neither the trigger 17 nor the safety 18 is activated, the circuit will continue to loop as at 43 in FIG. 7. If the trigger 17 is activated, and the safety 18 is not, the circuit will continue to loop as at 44 until the safety 18 is activated, at which point the output of control circuit 34 will energize the solenoid 32 of FIG. 2 or the solenoid 42 of FIG. 3, causing the tool to cycle. If from the initial normal state the safety 18 is first activated, the circuit will continue to loop as shown as 45 until trigger 17 is activated, at which point the output of circuit 34 will energize solenoid 32 of FIG. 2 or solenoid 42 of FIG. 3, causing the tool to cycle. If either the trigger 17 or the safety 18 is first activated, and then deactivated, the circuit will loop as at 43 in the same manner as though trigger 17 or the safety 18 had not been activated.

Once the tool cycles, if neither the trigger 17 nor the safety 18 is released, the circuit will continue to loop as at 46. If either the trigger 17 or the safety 18 is released, or both are released, the circuit will return as at 47 to its initial state.

The second basic mode of operation, the restrictive mode, requires that the safety 18 must always be activated first, followed by trigger 17. Whenever the safety 18 is deactivated, the trigger 17 must also be deactivated and the sequence started over, however, as long as the safety 18 is activated, the trigger 17 can be activated any number of times for repetitive cycles.

Figure 5:
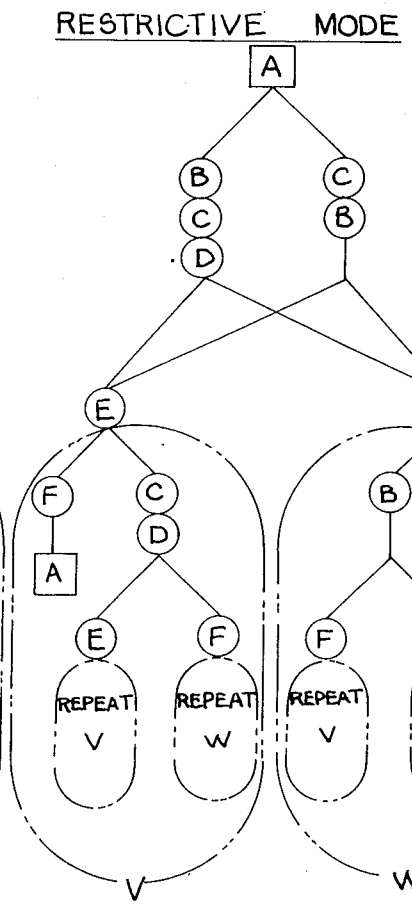

FIG. 5 is a state diagram for the restrictive mode and the letters in the diagram have the same meaning listed above with respect to FIG. 4. Thus, starting with the normal state or home position of the tool, and following the left-hand portion of the diagram of FIG. 5, if the safety 18 is first activated, followed by activation of trigger 17, the tool will cycle. After the first cycling of the tool, two different situations arise depending upon which of the trigger 17 and safety 18 is released first. If the trigger 17 is released first, as indicated at the left-hand portion of the diagram of FIG. 5, and this is followed by released of the safety 18, the tool will return to its normal state or home position. On the other hand, after the first cycling of the tool, if the trigger 17 is released and then reactivated, the tool will cycle for a second time. After cycling for the second time, if the trigger is next released, the states set forth in oval V can be followed. If the safety is released first, the states set forth in oval W (next to be described) can be followed.

After the first cycling, if the safety 18 is first released, the alternative states set forth in oval W can be achieved. For example, if the trigger 17 is released, following the release of safety 18, the tool will return to its normal state or home position. On the other hand, if following the first cycling of the tool the safety 18 is released, followed by reactivation of the safety, the tool will not cycle. If the operator next releases the trigger 17, either of the alternative sets of states set forth in oval V can be followed. If the operator, on the other hand, releases the safety 18, following reactivation of the safety, either of the alternative sets of states set forth in oval W, can be followed.

It will thus be apparent that, in the restrictive mode, the safety 18 must always be activated before trigger 17 for the tool to cycle. If the safety 18 remains activated, the trigger upon deactivation and reactivation will cycle the tool. If the safety 18 is deactivated, the trigger 17 must also be deactivated and the sequence begun again.

Figure 8:
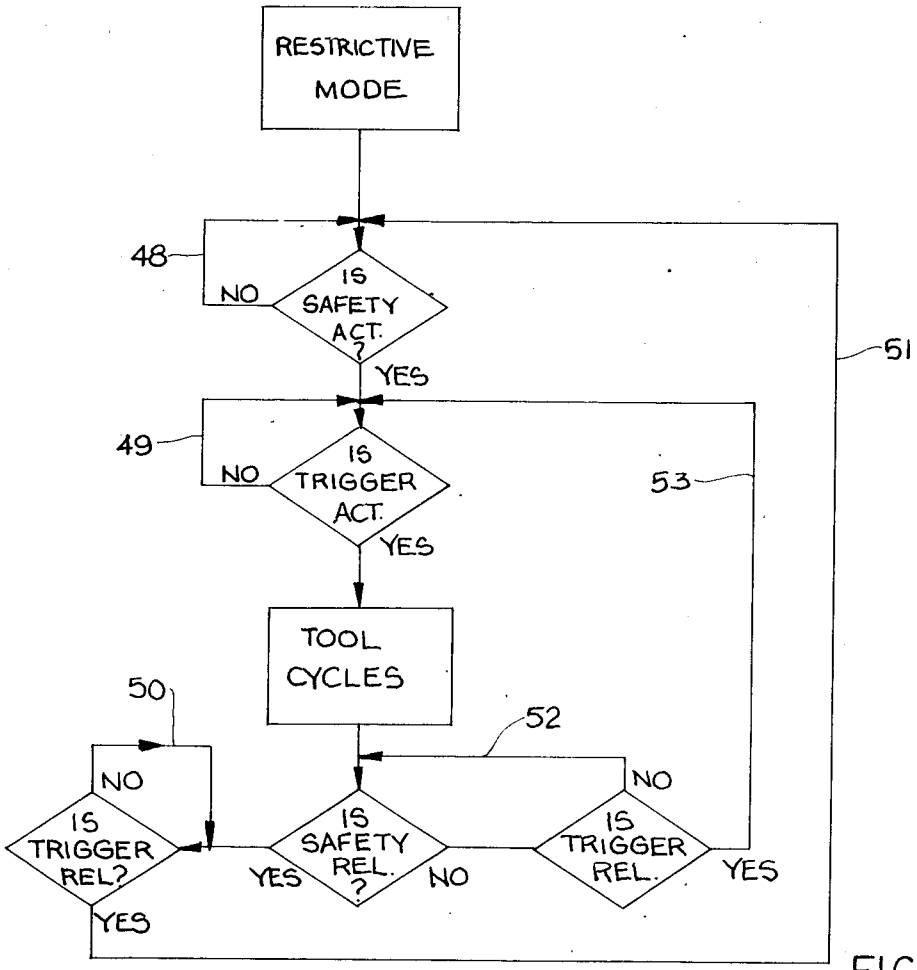
FIG. 8 is a flow diagram for the restrictive mode.

Reference is now made to FIG. 8 wherein a flow diagram for the restrictive mode is set forth. Once the circuit 34 of FIGS. 2 and 3 has been activated by the source of electrical circuit 33, the circuit will loop as at 48 until the safety 18 is activated. Following this, if the trigger is not activated, the circuit will continue to loop as at 49. If the trigger is activated, the tool will cycle.

Following cycling of the tool, if the safety 18 is released, and trigger 17 is not, the circuit will loop as at 50. Until the trigger is released, whereupon the circuit will return to its initial state as shown at 51. If, following cycling of the tool, the safety 18 is not released, and the same is true of trigger 17, the circuit will loop as at 52 until the trigger 17 is released. Upon release of trigger 17, the circuit will return as shown at 53 to that state wherein the safety 18 is activated, but the trigger 17 is not.

The final basic mode of operation of the tool, the sequential mode, is one in which the safety 18 must be activated first and then the trigger 17 to cycle the tool. Both the safety 18 and the trigger 17 must be deactivated before this sequence can start again.

Figure 6:
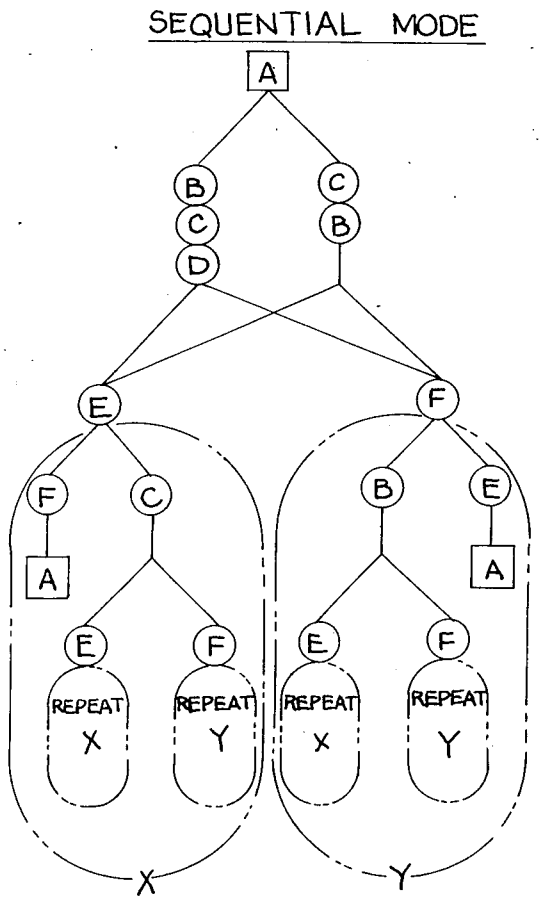

FIG. 6 is a state diagram for the sequential mode. Again, the letters in the diagram of FIG. 6 have the same meaning as is listed above with respect to FIG. 4.

Following the left-hand portion of the state diagram of FIG. 6, if from the normal state or home position of the tool the safety 18 is actuated, followed by actuation of trigger 17, the tool will cycle. Following the first cycling of the tool, if the trigger 17 is first released, followed by released of the safety 18, the tool will return to its normal state or home position. On the other hand, following the first cycling, if the trigger is first released and then reactivated, the tool will not fire. If, thereafter, the trigger is again released the alternative sets of states set forth in oval X can be followed. If the safety only is released, then the alternative sets of states set forth in oval Y (next to be described) can be followed.

If after the first cycling of the tool the safety 18 is released, followed by release of the trigger 17, the tool will return to its normal state or home position. If, upon cycling of the tool, the safety 18 is released, followed by reactivation of the safety 18, the tool will not fire. Under these circumstances if the trigger is next released the alternative sets of states set forth in oval X can be followed. If only the safety 18 is released, the alternative sets of states set forth in oval Y can be followed.

The state diagram of FIG. 6 also indicates that if from the normal state or home position of the tool the trigger 17 is first activated, followed by activation of the safety 18, the tool will not fire. Under the circumstances where the trigger 17 is activated before the safety 18, followed by release of trigger 17, either of the alternative sets of states of oval X can then be followed. If, following activation of the trigger 17 and thereafter safety 18, the safety is next released, then either of the alternative sets of states of oval Y can be followed.

Thus it will be evident from FIG. 6 that in order to cycle the tool both the trigger 17 and the safety 18 must be activated and in a special sequence (i.e., safety 18 followed by trigger 17). Furthermore, in order to cycle the tool again, both the trigger 17 and the safety 18 must be released and then reactivated in the above noted order.

Figure 9:
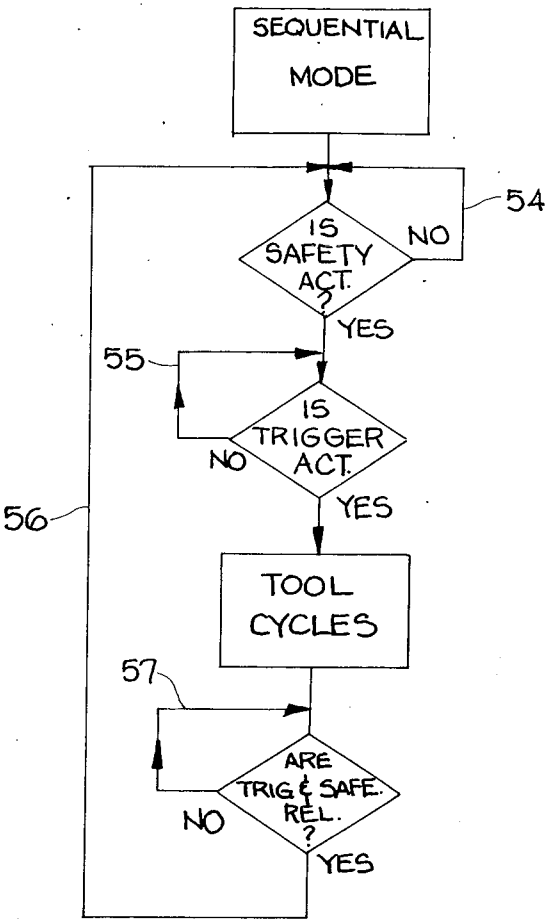
FIG. 9 is a flow diagram for the sequential mode.

Reference is now made to FIG. 9 wherein a flow diagram for the sequential mode is set forth. When the control circuit 34 of FIGS. 2 and 3 is designed for the sequential mode and energized by the source of electrical current 33, the circuit will loop as at 54 until the safety 18 is activated. When the safety 18 is activated, the circuit will loop as at 55 until the trigger 17 is activated. Activation of the safety 18 followed by activation of trigger 17 will cause the circuit 34 to have an output signal to the solenoid 32 of FIG. 2 or the solenoid 42 of FIG. 3, causing the tool to cycle. Following cycling of the tool, if both of the trigger 17 and the safety 18 are released, the circuit will return to its initial state, as shown at 56. If neither of the trigger 17 or the safety 18 are released, or only one of them, then the circuit will loop as at 57 until both are released.

Figure 10:
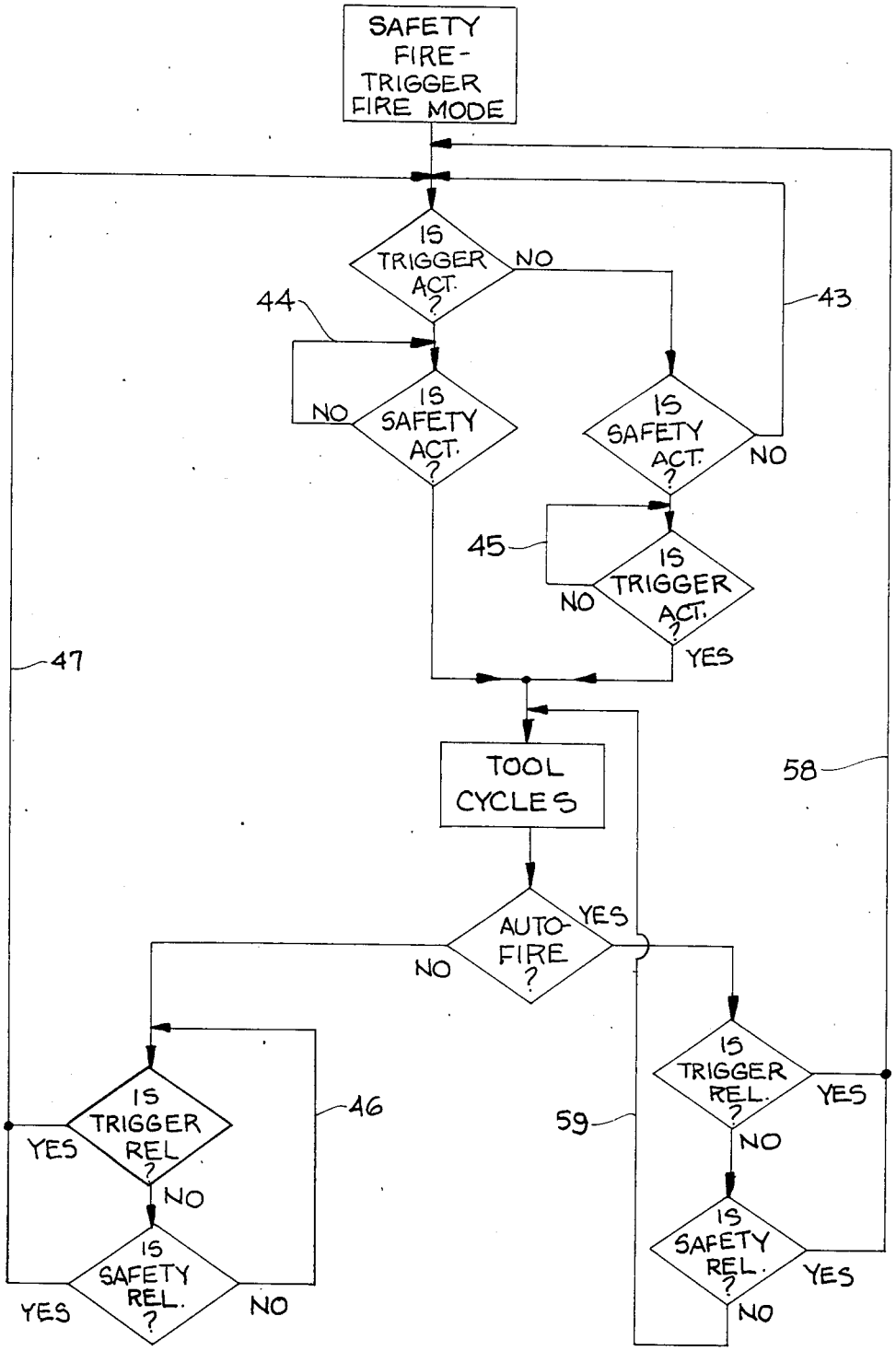
FIG. 10 is a flow diagram for the safety fire-trigger fire mode including auto-fire.

While the control circuits for all three basic modes of operation could be modified to include an auto-fire feature, it would not normally be desirable with the sequential mode of operation. A pneumatic fastener driving tool having the electronic controls of the present invention can easily be provided with an auto-fire feature without the necessity of complex valving and passageways in the tool. Reference is now made to FIG. 10 which is a flow diagram illustrating the safety fire-trigger fire mode provided with the auto-fire feature. It will be apparent that the flow diagram of FIG. 10 down to the point where the tool cycles is identical to the flow diagram of FIG. 7. Following the tool cycling state there is an auto-fire decision state. If the control circuit is not receiving an auto-fire input signal, the left-hand branch of the flow diagram of FIG. 10 will be followed. It will be noted that this left-hand branch of FIG. 10 is identical to that portion of flow diagram 7 beneath the tool cycling state. If the operator has actuated the auto-fire selector, and an auto-fire input signal is being received by the control circuit 34, the lower right-hand branch of the flow diagram of FIG. 10 will be followed. If either the trigger 17 or the safety 18 has been released, or if both have been released, the control circuit will return to its original state, as shown at 58. If neither the trigger 17 nor the safety 18 has been released, the tool will continue to cycle, as indicated at 59.

It will be apparent from FIG. 10 that when the tool operator has not actuated the auto-fire selector, the control circuit will function in the same manner described with respect to FIGS. 4 and 7. If the auto-fire selector is actuated, the tool will continue to cycle so long as both the trigger 17 and the safety 18 are not released. Release of either one or both of the trigger 17 and safety 18 will return the control circuit to its normal initial state.

Figure 11:
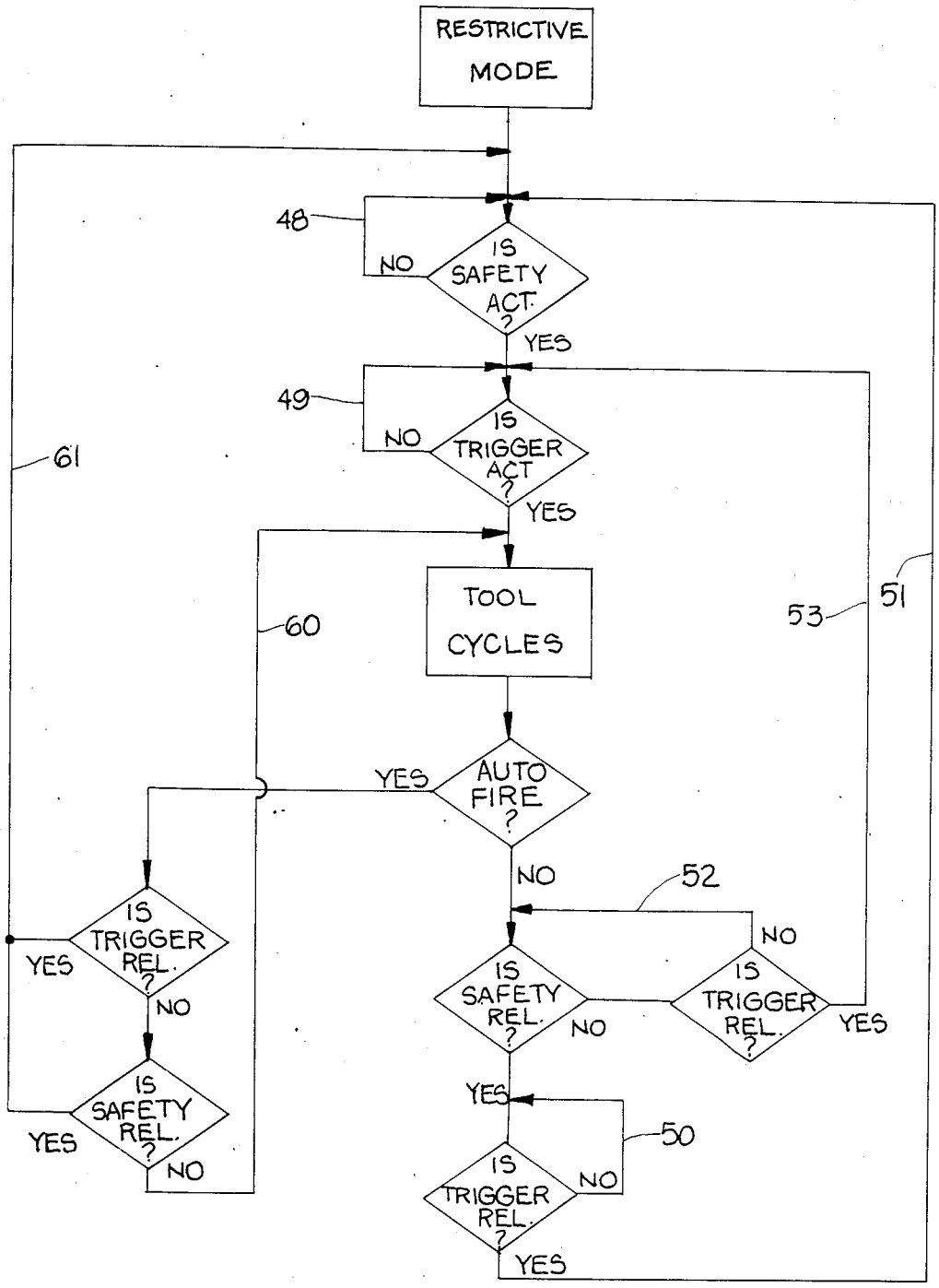
FIG. 11 is a flow diagram for the restrictive mode, including auto-fire.

FIG. 11 comprises a flow diagram for a control circuit designed for the restrictive mode and provided with the auto-fire feature. Again it will be noted that that portion of the flow diagram down to the tool cycling state is identical to the flow diagram of FIG. 8. Following the tool cycling state, there is a decision state for the auto-fire feature. If the operator has not actuated the auto-fire selector, the remainder of the flow diagram of FIG. 11 is identical to the remainder of the flow diagram of FIG. 8. If the auto-fire selector has been actuated, and the control circuit is receiving an auto-fire input signal, the tool will continue to cycle so long as both the trigger 17 and the safety 18 have not been released, as is indicated at 60. If either the trigger 17 or the safety 18 is released, or if both are released, the circuit will go back to its normal initial state, as indicated at 61.

As in the case of FIG. 10, it is apparent from the flow diagram of FIG. 11 that if the auto-fire selector switch has not been actuated and if the control circuit does not receive an auto-fire input signal, the circuit will function in the same manner described with respect to FIGS. 5 and 8. When the operator activates the auto-fire selector, the tool will continue to cycle so long as the trigger 17 and the safety 18 are not released. Release of one or both will end the auto-fire cycling.

The auto-fire selector switch **38*a* (see FIGS. 2 and 3**) can be a variable (continuously or stepped) switch so that the auto-fire feature can be varied as to rate of cycling, as for example, from 1 to 20 cycles per second.

Provided with the state diagrams of FIGS. 4 through 6 and the flow diagrams of FIGS. 7 through 11, the control circuits of the present invention can be designed and implemented in numerous ways by one of ordinary skill in the art. The particular way in which the circuits of the present invention are designed and implemented does not constitute a limitation on the present invention. As indicated above the control circuit 34 may have built-in safety features such as a predetermined time delay within which both the trigger 17 and the safety 18 must be activated or the tool will be precluded from cycling.

The teachings of the present invention can be applied to pneumatic fastener driving tools of various sizes. The same control circuit can be used. Different power sources and pneumatic-electronic interface values may be required.

Modifications may be made in the invention without departing from the spirit of it.

What I claim is:

1. A pneumatic fastener driving tool and an electronic control system therefor, said tool comprising a body containing a cylinder and a piston, a driver mounted on said piston, a firing valve above and normally closing the upper end of said cylinder, a reservoir connected to a source of air under pressure, a volume above said firing valve, said volume being connectable to said reservoir such that air under pressure from said reservoir maintains said firing valve closed, said volume being connectable to exhaust to open said firing valve and permit air under pressure to enter said cylinder above said piston and to cycle said tool, said volume normally being connected to said reservoir, a manual trigger, a workpiece responsive trip, a magazine and a plurality of fasteners within said magazine, said electronic control system comprising a solenoid actuated valve and a solenoid therefor, said solenoid actuated valve being ported to connect said volume above said firing valve to exhaust when said solenoid is actuated, control circuit means having an output connected to said solenoid to actuate said solenoid, said control circuit having inputs at least from said manual trigger and said workpiece responsive trip, said control circuit means being operative to determine the mode of operation of said tool, to interpret said inputs and to generate an output to said solenoid when said inputs satisfy said mode of operation.

2. The tool and control system claimed in claim 1 including a passage in said body from said volume to said solenoid actuated valve and passages in said body from said solenoid actuated valve to said reservoir and to exhaust, said solenoid actuated valve comprising a three-way valve shiftable by said solenoid from a normal first position wherein it connects said passage from said volume to said passage to said reservoir and disconnects said passage from said volume from said exhaust passage to a second actuated position wherein it connects said passage from said volume to said exhaust passage and disconnects said passage from said volume from said passage to said reservoir when said solenoid is actuated by the output of said control circuit means, said solenoid actuated valve being biased to its normal first position.

3. The tool and control system claimed in claim 1 including a second valve, a passage from said volume to said second valve, a passage from said second valve to said reservoir and a passage from said second valve to exhaust, said second valve comprising a three-way valve shiftable by one of said manual trigger and said workpiece responsive trip from a normal first position wherein it connects said passage from said volume to said passage to said reservoir and disconnects said passage from said volume from said exhaust passage to a second actuated position wherein it connects said passage from said volume to said exhaust passage and disconnects said passage from said volume from said passage to said reservoir when said one of said manual trigger and said workpiece responsive trip is actuated, said second valve being biased to its normal first position, said solenoid actuated valve comprising a two-way valve and being located in said exhaust passage, said solenoid actuated valve being shiftable by said solenoid from a normal first position wherein it closes said exhaust passage to a second actuated position wherein it opens said exhaust passage when said solenoid is actuated by said output of said control circuit, said solenoid actuated valve being biased to its normal first position.

4. The tool and control system claimed in claim 1 wherein said control circuit means is chosen from the class consisting of a digital electronic circuit, a microprocessor and an electro-mechanical circuit.

5. The tool and control system claimed in claim 1 including at least one additional input to said control circuit means chosen from the class consisting of an empty magazine sensor input, an ambient gas sensor input, an air pressure sensor input, a broken tool sensor input an an auto-fire selector switch input.

6. The tool and control system claimed in claim 1 including an input to said control circuit means from at least one safety device switch.

7. The tool and control system claimed in claim 1 including an input to said control circuit means from an auto-fire selector switch.

8. The tool and control system claimed in claim 1 wherein said control circuit means is operative to determine a mode of operation requiring both said manual trigger and said workpiece responsive trip to be control circuit means to cycle said tool, said mode of operation further requiring either one or both of said manual trigger and said workpiece responsive trip to be deactuated and reactuated to produce an output from said control circuit means to recycle said tool.

9. The tool and control system claimed in claim 1 wherein said control circuit means is operative to determine a mode of operation requiring both said workpiece responsive trip and said manual trigger to be actuated, with said workpiece responsive trip being actuated before of said manual trigger, to produce an output from said control circuit means to cycle said tool, said mode of operation further requiring both said workpiece responsive trip and said manual trigger to be deactuated and reactuated, workpiece responsive trip first, to produce an output from said control means to recycle said tool, said mode of operation further requiring deactuation and reactuation of said manual trigger only to produce an output from said control circuit means to recycle said tool when said workpiece responsive trip remains actuated.

10. The tool and control system claimed in claim 1 wherein said control circuit means is operative to determine a third mode of operation requiring both said workpiece responsive trip and said manual trigger to be actuated, with said workpiece responsive trip being actuated before said manual trigger, to produce an output from said control circuit means to cycle said tool, said third mode of operation further requiring both said workpiece responsive trip and said manual trigger to be deactuated and reactuated, workpiece responsive trip first, to produce an output from said control circuit means to recycle said tool.

11. The tool and control system claimed in claim 1 wherein said control circuit means is operative to determine first, second and third modes of operation, said first mode of operation requiring both said manual trigger and said workpiece responsive trip to be actuated in any order to produce an output from said control circuit means to cycle said tool, said first mode of operation further requiring either one or both of said manual trigger and said workpiece responsive trip to be deactuated and reactuated to produce an output from said control circuit means to recycle said tool, said second mode of operation requiring both said workpiece responsive trip and said manual trigger to be actuated, with said workpiece responsive trip being actuated before of said manual trigger, to produce an output from said control circuit means to cycle said tool, said second mode of operation further requiring both said workpiece responsive trip and said manual trigger to be deactuated and reactuated, workpiece responsive trip first, to produce an output from said control circuit means to recycle said tool, said second mode of operation further requiring deactuation and reactuation of said manual trigger only to produce an output from said control circuit means to recycle said tool when said workpiece responsive trip remains actuated, said third mode of operation requiring both said workpiece responsive trip and said manual trigger to be actuated, with said workpiece responsive trip being actuated before said manual trigger, to produce an output from said control circuit means to cycle said tool, said third mode of operation further requiring both said workpiece responsive trip and said manual trigger to be deactuated and reactuated, workpiece responsive trip first, to produce an output from said control circuit means to recycle said tool.

12. The tool and control system claimed in claim 2 wherein said control circuit means is chosen from the class consisting of a digital electronic circuit, a microprocessor and an electro-mechanical circuit.

13. The tool and control system claimed in claim 2 including at least one additional input to said control circuit means chosen from the class consisting of an empty magazine sensor input, an ambient gas sensor input, an air pressure sensor input, a broken tool sensor input an an auto-fire selector switch input.

14. The tool and control system claimed in claim 2 including an input to said control circuit means from at least one safety device switch.

15. The tool and control system claimed in claim 2 including an input to said control circuit means from an auto-fire selector switch.

16. The tool and control system claimed in claim 2 wherein said control circuit means is operative to determine a mode of operation requiring both said manual trigger and said workpiece responsive trip to be actuated in any order to produce an output from said control circuit means to cycle said tool, said mode of operation further requiring either one or both of said manual trigger and said workpiece responsive trip to be deactuated and reactuated to produce an output from said control circuit means to recycle said tool.

17. The tool and control system claimed in claim 2 wherein said control circuit means is operative to determine a mode of operation requiring both said workpiece responsive trip and said manual trigger to be actuated, with said workpiece responsive trip being actuated before of said manual trigger, to produce an output from said control circuit means to cycle said tool, said mode of operation further requiring both said workpiece responsive trip and said manual trigger to be deactuated and reactuated, workpiece responsive trip first, to produce an output from said control means to recycle said tool, said mode of operation further requriing deactuation and reactuation of said manual trigger only to produce an output from said control circuit means to recycle said tool when said workpiece responsive trip remains actuated.

18. The tool and control system claimed in claim 2 wherein said control circuit means is operative to determine a mode of operation requiring both said workpiece responsive trip and said manual trigger to be actuated, with said workpiece responsive trip being actuated before said manual trigger, to produce an output from said control circuit means to cycle said tool, said mode of operation further requiring both said workpiece responsive trip and said manual trigger to be deactuated and reactuated, workpiece responsive trip first, to produce an output from said control circuit means to recycle said tool.

19. The tool and control system claimed in claim 2 wherein said control circuit means is operative to determine first, second and third modes of operation, said first mode of operation requiring both said manual trigger and said workpiece responsive trip to be actuated in any order to produce an output from said control circuit means to cycle said tool, said first mode of operation further requiring either one or both of said manual trigger and said workpiece responsive trip to be deactuated and reactuated to produce an output from said control circuit means to recycle said tool, said second mode of operation requiring both said workpiece responsive trip and said manual trigger to be actuated, with said workpiece responsive trip being actuated before of said manual trigger, to produce an output from said control circuit means to cycle said tool, said second mode of operation further requiring both said workpiece responsive trip and said manual trigger to be deactuated and reactuated, workpiece responsive trip first, to produce an output from said control circuit means to recycle said tool, said second mode of operation further requiring deactuation and reactuation of said manual trigger only to produce an output from said control circuit means to recycle said tool when said workpiece responsive trip remains actuated, said third mode of operation requiring both said workpiece responsive trip and said manual trigger to be actuated, with said workpiece responsive trip being actuated before said manual trigger, to produce an output from said control circuit means to cycle said tool, said third mode of operation further requiring both said workpiece responsive trip and said manual trigger to be deactuated and reactuated, workpiece responsive trip first, to produce an output from said control circuit means to recycle said tool.

20. The tool and control system claimed in claim 3 wherein said control circuit means is chosen from the class consisting of a digital electronic circuit, a microprocessor and an electro-mechanical circuit.

21. The tool and control system claimed in claim 3 including at least one additional input to said control circuit means chosen from the class consisting of an empty magazine sensor input, an ambient gas sensor input, an air pressure sensor input, a broken tool sensor input an an auto-fire selector switch input.

22. The tool and control system claimed in claim 3 including an input to said control circuit means from at least one safety device switch.

23. The tool and control system claimed in claim 3 including an input to said control circuit means from an auto-fire selector switch.

24. The tool and control system claimed in claim 3 wherein said control circuit means is operative to determine a mode of operation requiring both said manual trigger and said workpiece responsive trip to be actuated in any order to produce an output from said control circuit means to cycle said tool, said mode of operation further requiring either one or both of said manual trigger and said workpiece responsive trip to be deactuated and reactuated to produce an output from said control circuit means to recycle said tool.

25. The tool and control system claimed in claim 3 wherein said control circuit means is operative to determine a mode of operation requiring both said workpiece responsive trip and said manual trigger to be actuated, with said workpiece responsive trip being actuated before of said manual trigger, to produce an output from said control circuit means to cycle said tool, said mode of operation further requiring both said workpiece responsive trip and said manual trigger to be deactuated and reactuated, workpiece responsive trip first, to produce an output from said control means to recycle said tool, said mode of operation further requriing deactuation and reactuation of said manual trigger only to produce an output from said control circuit means to recycle said tool when said workpiece responsive trip remains actuated.

26. The tool and control system claimed in claim 3 wherein said control circuit means is operative to determine a mode of operation requiring both said workpiece responsive trip and said manual trigger to be actuated, with said workpiece responsive trip being actuated before said manual trigger, to produce an output from said control circuit means to cycle said tool, said mode of operation further requiring both said workpiece responsive trip and said manual trigger to be deactuated and reactuated, workpiece responsive trip first, to produce an output from said control circuit means to recycle said tool.

27. The tool and control system claimed in claim 3 wherein said control circuit means is operative to determine first, second and third modes of operation, said first mode of operation requiring both said manual trigger and said workpiece responsive trip to be actuated in any order to produce an output from said control circuit means to cycle said tool, said first mode of operation further requiring either one or both of said manual trigger and said workpiece responsive trip to be deactuated and reactuated to produce an output from said control circuit means to recycle said tool, said second mode of operation requiring both said workpiece responsive trip and said manual trigger to be actuated, with said workpiece responsive trip being actuated before of said manual trigger, to produce an output from said control circuit means to cycle said tool, said second mode of operation further requiring both said workpiece responsive trip and said manual trigger to be deactuated and reactuated, workpiece responsive trip first, to produce an output from said control circuit means to recycle said tool, said second mode of operation further requiring deactuation and reactuation of said manual trigger only to produce an output from said control circuit means to recycle said tool when said workpiece responsive trip remains actuated, said third mode of operation requiring both said workpiece responsive trip and said manual trigger to be actuated, with said workpiece responsive trip being actuated before said manual trigger, to produce an output from said control circuit means to cycle said tool, said third mode of operation further requiring both said workpiece responsive trip and said manual trigger to be deactuated and reactuated, workpiece responsive trip first, to produce an output from said control circuit means to recycle said tool.

28. The tool and control system claimed in claim 8 including an input to said control circuit means from an auto-fire selector switch, when said input from said auto-fire selector switch is activated, said first mode of operation requires that once said manual trigger and workpiece responsive trip have been actuated in any order, said tool will continue to cycle until at least one of said manual trigger and said workpiece responsive trip is deactuated.

29. The tool and control system claimed in claim 9 including an input to said control circuit means from an auto-fire selector switch, when said input from said auto-fire selector switch is activated, said second mode of operation requires that once said workpiece responsive trip has been actuated, followed by actuation of said manual trigger, said tool will continue to cycle until at least one of said workpiece responsive trip and said manual trigger is deactuated.

30. The tool and control system claimed in claim 11 including an input to said control circuit means from an auto-fire selector switch, when said input from said auto-fire selector switch is activated, and said workpiece responsive trip and manual trigger are actuated in accordance with one of said first, second and third modes of operation, said tool will continue to cycle until at least one of said workpiece responsive trip and said manual trigger is deactuated.

31. The tool and control system claimed in claim 16 including an input to said control circuit means from an auto-fire selector switch, when said input from said auto-fire selector switch is activated, said first mode of operation requires that once said manual trigger and workpiece responsive trip have been actuated in any order, said tool will continue to cycle until at least one of said manual trigger and said workpiece responsive trip is deactuated.

32. The tool and control system claimed in claim 17 including an input to said control circuit means from an auto-fire selector switch, when said input from said auto-fire selector switch is activated, said second mode of operation requires that once said workpiece responsive trip has been actuated, followed by actuation of said manual trigger, said tool will continue to cycle until at least one of said workpiece responsive trip and said manual trigger is deactuated.

33. The tool and control system claimed in claim 19 including an input to said control circuit means from an auto-fire selector switch, when said input from said auto-fire selector switch is activated, and said workpiece responsive trip and manual trigger are actuated in accordance with one of said first, second and third modes of operation, said tool will continue to cycle until at least one of said workpiece responsive trip and said manual trigger is deactuated.

34. The tool and control system claimed in claim 24 including an input to said control circuit means from an auto-fire selector switch, when said input from said auto-fire selector switch is activated, said first mode of operation requires that once said manual trigger and workpiece responsive trip have been actuated in any order, said tool will continue to cycle until at least one of said manual trigger and said workpiece responsive trip is deactuated.

35. The tool and control system claimed in claim 29 including an input to said control circuit means from an auto-fire selector switch, when said input from said auto-fire selector switch is activated, said second mode of operation requires that once said workpiece responsive trip has been actuated, followed by actuation of said manual trigger, said tool will continue to cycle until at least one of said workpiece responsive trip and said manual trigger is deactuated.

36. The tool and control system claimed in claim 27 an input to said control circuit means from an auto-fire selector switch, when said input from said auto-fire selector switch is activated, and said workpiece responsive trip and manual trigger are actuated in accordance with one of said first, second and third modes of operation, said tool will continue to cycle until at least one of said workpiece responsive trip and said manual trigger is deactuated.

* * * * *